US011518641B2

(12) United States Patent
Takahashi et al.

(10) Patent No.: US 11,518,641 B2
(45) Date of Patent: Dec. 6, 2022

(54) SHEET CONVEYING APPARATUS AND IMAGE FORMING APPARATUS

(71) Applicants: Masaya Takahashi, Yamanashi-ken (JP); Kota Hihara, Yamanashi-ken (JP)

(72) Inventors: Masaya Takahashi, Yamanashi-ken (JP); Kota Hihara, Yamanashi-ken (JP)

(73) Assignee: CANON FINETECH NISCA INC., Misato (JP)

( * ) Notice: Subject to any disclaimer, the term of this patent is extended or adjusted under 35 U.S.C. 154(b) by 33 days.

(21) Appl. No.: 17/156,932

(22) Filed: Jan. 25, 2021

(65) Prior Publication Data

US 2021/0245988 A1 Aug. 12, 2021

(30) Foreign Application Priority Data

Feb. 7, 2020 (JP) ..... JP2020-019918

(51) Int. Cl.
*B65H 29/58* (2006.01)
*B65H 31/10* (2006.01)
*B65H 31/02* (2006.01)
*B65H 29/12* (2006.01)

(52) U.S. Cl.
CPC ..... *B65H 31/10* (2013.01); *B65H 29/125* (2013.01); *B65H 31/02* (2013.01)

(58) Field of Classification Search
CPC .. B65H 29/58; B65H 29/60; G03G 221/1604; G03G 221/1609
See application file for complete search history.

(56) References Cited

U.S. PATENT DOCUMENTS 7,111,839 B2 * 9/2006 Nishimura ..... B65H 29/20 270/58.11
7,429,037 B2 * 9/2008 Kawata ..... B65H 31/02 270/32
7,489,898 B2 * 2/2009 Hayashi ..... G03G 15/6538 399/407
7,530,560 B2 * 5/2009 Kushida ..... B65H 29/58 270/58.11
7,637,502 B2 * 12/2009 Ata ..... B42C 1/10 270/58.11
10,496,031 B2 * 12/2019 Sugiyama ..... B65H 31/10
10,585,385 B2 * 3/2020 Taniguchi ..... B65H 39/10
(Continued)

FOREIGN PATENT DOCUMENTS

JP 2019-139054 A 8/2019

*Primary Examiner* — Leslie A Nicholson, III
(74) *Attorney, Agent, or Firm* — Manabu Kanesaka

(57) ABSTRACT

To provide an image forming apparatus having a sheet processing apparatus installed in an in-body space, capable of discharging sheets of different sizes without interfering with discharge operation of the sheet processing apparatus in a compact configuration. An image forming apparatus has a sheet binding unit disposed in an in-body space part thereof, a first conveying path for conveying the sheet discharged to the in-body space part toward the sheet binding unit, and a second conveying path for conveying the sheet discharged to the in-body space part toward a second stack tray that stacks thereon the sheet vertically below a first stack tray disposed outside the in-body space part. The second conveying path extends, inside the in-body space part, substantially horizontally between an image forming part and the sheet binding unit.

7 Claims, 7 Drawing Sheets

(56) References Cited

U.S. PATENT DOCUMENTS

| | | | | |
|---|---|---|---|---|
| 10,604,370 | B2 * | 3/2020 | Yamamoto | B65H 31/24 |
| 10,800,631 | B2 * | 10/2020 | Kubo | B65H 31/12 |
| 10,828,925 | B2 * | 11/2020 | Kubo | B65H 31/24 |
| 2019/0163111 | A1 * | 5/2019 | Taniguchi | B65H 29/60 |

* cited by examiner

SHEET CONVEYING APPARATUS AND IMAGE FORMING APPARATUS

TECHNICAL FIELD

The present invention relates to an image forming apparatus, such as a copier, a printer, a facsimile, or a digital multifunction machine having combined functions thereof, provided with a sheet processing apparatus that applies predetermined processing to image-formed sheets.

BACKGROUND ART

There is known a sheet processing apparatus which is provided in an image forming system having an image forming apparatus for forming an image on a sheet as a core component and which applies, to sheets discharged from the image forming apparatus, processing such as punching, binding, aligning, sorting, and the like. The sheet processing apparatus that performs such processing includes a so-called side-face installation type and an in-body installation type. The side-face installation type sheet processing apparatus is provided independently of the image forming apparatus and disposed beside the main body of the image forming apparatus so as to receive sheets discharged from the side surface of the image forming apparatus main body. The in-body installation type sheet processing apparatus is disposed in an in-body space provided in the installation area of the image forming apparatus main body.

The side-face installation type sheet processing apparatus is connected to the outer cover side of the image forming apparatus main body to constitute an image forming system, so that a large installation space is required for the overall system. On the other hand, the in-body installation type sheet processing apparatus is housed within the installation area of the image forming apparatus main body, so that the installation space can significantly be saved as compared to the side-face installation type sheet processing apparatus (see, for example, JP2019-139054A).

The image forming apparatus disclosed in JP2019-139054A is provided with a sheet processing apparatus in the in-body space thereof and has a first stack tray to which sheets that have been processed by the sheet processing apparatus are discharged and a second stack tray that receives sheets in the in-body space provided above the sheet processing apparatus. When a sheet discharged to the second stack tray is a long sheet (e.g., A3 or larger sheet), the sheet discharged to the second stack tray may protrude from the second stack tray to hang over the first stack tray, which interferes with the operation of discharging the sheet to the first stack tray.

DISCLOSURE OF INVENTION

Problems to be Solved by the Invention

The present invention has been made in view of the above problem, and an object thereof is to provide an image forming apparatus having an in-body space within the installation area of an image forming apparatus main body, in which a sheet processing apparatus having a sheet processing part that performs sheet post-processing is disposed, the image forming apparatus being capable of discharging sheets of different sizes without interfering with discharge operation of the sheet processing apparatus in a compact configuration.

Means for Solving the Problem

According to an aspect of the present invention, there is provided an image forming apparatus including: an image reading part for reading an image; an image forming part disposed with an in-body space part provided vertically below the image reading part interposed therebetween and configured to form an image on a sheet; a sheet processing apparatus including a sheet processing part provided inside the in-body space part between the image reading part and the image forming part and configured to apply predetermined processing to sheets and a first stacking part disposed adjacent to the sheet processing part and outside the in-body space part and configured to stack thereon the sheets processed by the sheet processing part; a first discharge part for discharging the sheet on which an image is formed by the image forming part toward the in-body space part; a second discharge part provided outside the in-body space part and vertically below the first stacking part and configured to discharge the sheet; and a relay conveying unit including a first conveying path for conveying the sheet discharged from the first discharge part toward the sheet processing apparatus and a second conveying path extending between the sheet processing apparatus in the in-body space part and the image forming part and configured to convey the sheet discharged from the first discharge part toward the second discharge part.

Further, according to another aspect of the present invention, there is provided a sheet conveying apparatus attached to an image forming system including: an image reading part for reading an image; an image forming part disposed with an in-body space part provided vertically below the image reading part interposed therebetween and configured to form an image on a sheet; a sheet processing apparatus including a sheet processing part provided inside the in-body space part between the image reading part and the image forming part and configured to apply predetermined processing to sheets and a first stacking part disposed adjacent to the sheet processing part and outside the in-body space part and configured to stack thereon the sheets processed by the sheet processing part, the sheet conveying apparatus including: a sheet receiving part for receiving a sheet on which an image is formed by the image forming part and discharged toward the in-body space part; a sheet discharge part provided outside the in-body space part and vertically below the first stacking part and configured to discharge the sheet; a first conveying path for conveying the sheet received by the sheet receiving part toward the sheet processing apparatus; and a second conveying path provided so as to extend between the sheet processing apparatus inside the in-body space part and the image forming part and configured to convey the sheet received by the sheet receiving part toward the sheet discharge part.

Advantageous Effect of the Invention

According to the present invention, it is possible to discharge sheets of different sizes without interfering with discharge operation of the sheet processing apparatus in a compact configuration.

MODE FOR CARRYING OUT THE INVENTION

Figure 1:
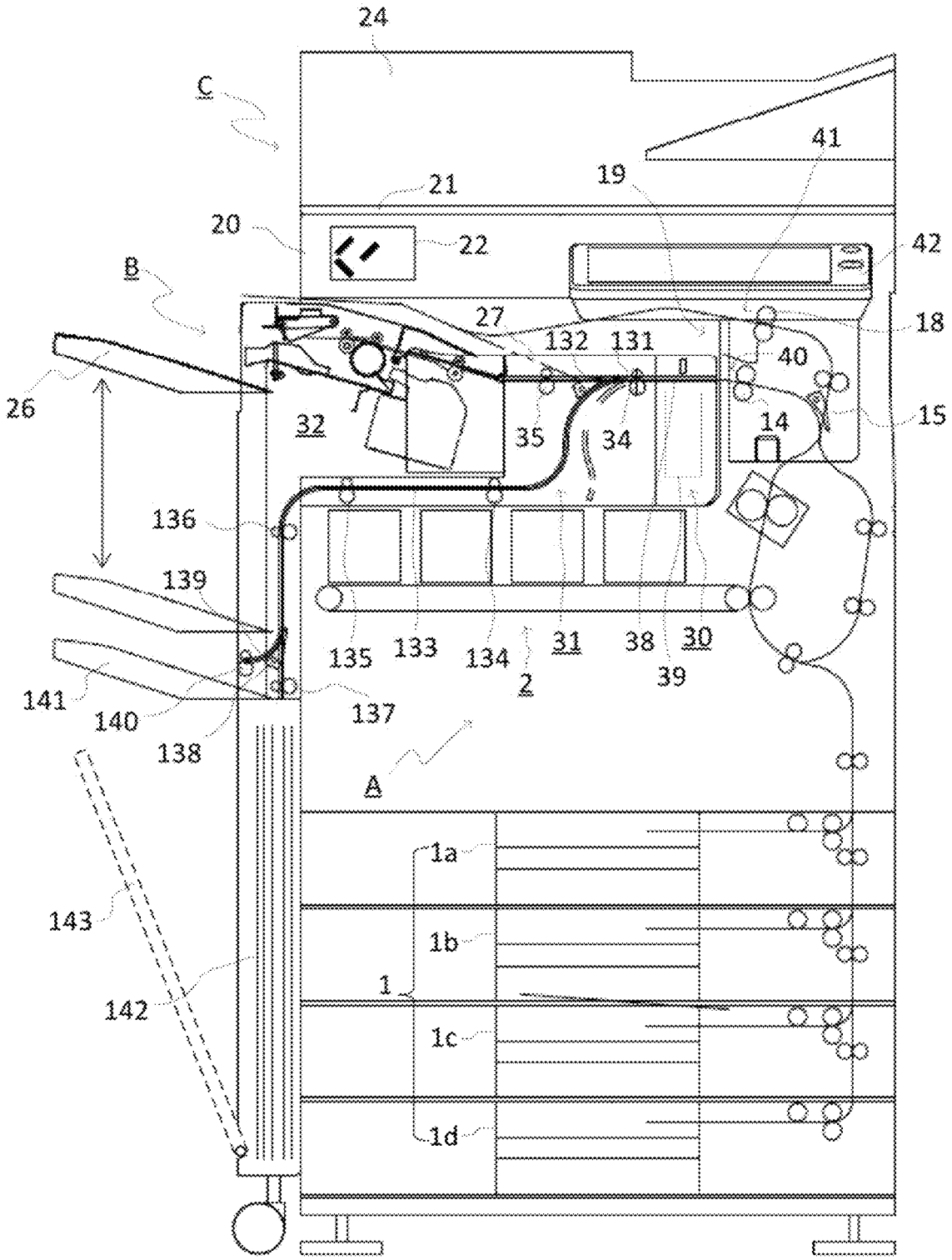
FIG. 1 is an explanatory view of the entire configuration of an image forming apparatus having a relay conveying unit according to the present invention.

Hereinafter, a sheet post-processing unit B as a discharge unit according to the present invention and an image forming unit A to which the sheet post-processing unit B is attached will be described with reference to the drawings. FIG. 1 is an explanatory view illustrating the entire configuration of an image forming apparatus combining the image forming unit A, the sheet post-processing unit B, and an image reading unit C. The image reading unit C reads an image on a document or the like as image data, and the image forming unit A forms an image on a sheet based on the image data. Then, in the sheet post-processing unit B, the image-formed sheets are punched, stacked in an aligned manner, bound, and stacked on a first stack tray (first stacking part) positioned downstream in a sheet conveying direction. On the other hand, sheets that are not subjected to processing in the sheet post-processing unit B are stacked on a second stack tray (second stacking part, third stacking part, fourth stacking part) positioned above the sheet post-processing unit B.

The sheet post-processing unit B to be described later is incorporated as one unit in an in-body sheet discharge space 19 formed in the housing of the image forming unit A and includes a punch unit 30, a relay conveying unit 31, and a sheet binding unit 32. The punch unit 30 applies punching to image-formed sheets conveyed to a first discharge port 40 (first discharge part). The relay conveying unit 31 relays the sheets between units. The sheet binding unit 32 accumulates the sheets on a processing tray in an aligned state, applies binding thereto, and stacks the bound sheets on the first stack tray disposed downstream in the sheet conveying direction. Further, although not illustrated, a configuration may be adopted, in which the punch unit 30 that applies punching to the sheets and the relay conveying unit 31 that relays the sheets between units are omitted. In this case, the sheet binding unit 32 may directly receive sheets conveyed from the first discharge port 40.

Further, there is provided an operation part 42 for an operator of the image forming apparatus to select: a reading mode (one-side reading, double-side reading, color reading, monochrome reading, etc.) for the image reading unit C; an image formation mode (one-side printing, double-side printing, a sheet size, etc.) for the image forming unit A; and a processing mode (punching, binding, etc.) for the sheet post-processing unit B, and to check information and a status.

An apparatus front side Fr in the description of the apparatus according to the present invention refers to the apparatus front side at which an operator of the apparatus performs various operations. In an ordinary image forming apparatus, there is provided, on the apparatus front side Fr, an operation part 42 (operation panel) for the operator to input processing information, to check the status of the apparatus, and the like, a cover (opening/closing cover) for a sheet cassette of the image forming apparatus, or an opening/closing cover for replenishment of staples of a stapler unit. An apparatus rear side Re refers to the side of the apparatus that faces the wall of a building or the like in an installed state of the apparatus (when the design condition specifies that the apparatus rear side faces a wall). Further, in every sectional view of the apparatus seen from the front side, a sheet movement direction from the right to the left is defined as a sheet discharge direction unless otherwise specified.

[Image Formation Unit]

The image forming unit A illustrated in FIG. 1 is of an electrophotographic type. A sheet feed part 1 including four sheet cassettes 1*a*, 1*b*, 1*c*, and 1*d* for storing sheets is provided below an image forming part 2. The sheet post-processing unit B is disposed above the image forming part 2, and the image reading unit C is disposed above the sheet post-processing unit B. Thus, the sheet post-processing unit B is of an in-body installation type. That is, the sheet post-processing unit B is disposed in a space between the image reading unit C and the image forming part 2. When the sheet post-processing unit B is not attached to the image forming unit A, the in-body sheet discharge space 19 between the sheet post-processing unit B and the image reading unit C can be used as a sheet stacking part for stacking sheets discharged from the image forming part 2.

A stack tray to which an image-formed sheet is discharged is selected based on subsequent processing or sheet size. When the sheet is subjected to punching or binding, the sheet is discharged toward the sheet post-processing unit B through the first discharge port 40 and subjected to punching by the punch unit 30 according to the selection. Then, the sheet is conveyed to the sheet binding unit 32 through the relay conveying unit 31 and subjected to binding according to the selection. After the selected processing, the sheet is stacked on the first stack tray. On the other hand, when a sheet (special sheet) that is not a long sheet (e.g., longer size than A3 sheet having a longitudinal side of 420 mm) and subjected to neither binding nor shifting, it is discharged through a third discharge port 41 (third discharge part) and is then stacked on the second stack tray provided above the sheet post-processing unit B. When a long sheet is selected, a conveying path is switched in the relay conveying unit 31 so as to discharge the long sheet to a second stack tray 141 or a discharge box 142 through a conveying path 133.

[Image Reading Unit]

The image reading unit C includes an image reading apparatus 20 and a document automatic feeder 24. The image reading apparatus 20 includes a platen 21 and a reading carriage 22 reciprocating along the platen 21. The platen 21 is made of transparent glass. An image reading mode of the image reading unit C includes a still image reading mode and a traveling image reading mode. In the still image reading mode, a document to be read is placed on the upper surface of the platen 21, and the carriage 22 is moved for image reading; while in the traveling image reading mode, a document to be read is conveyed at a predetermined conveying speed by the document automatic feeder 24, and the carriage 22 is stopped at a predetermined position for image reading.

[Punch Unit]

The punch unit 30 includes a punching unit 38 for punching the sheet discharged from the first discharge port 40 and passing through a sheet conveying path in the punch unit 30. A first main body discharge roller 14 for sheet conveyance is disposed upstream relative to the punching unit 38 in the sheet conveying direction and is connected to a not-shown drive motor. A not-shown controller (CPU, etc.) is connected to a motor driver that supplies a drive signal to the drive motor. When the controller receives a command instructing it to perform punching from an operation part to be described later that receives a user's operation, it temporarily stops the sheet at the punching position.

The punching unit 38 includes a not-shown punch mechanism 38*a* that punches a punch hole in a sheet passing through the sheet conveying path in the punch unit 30 and a punch waste box 39 that stores punching chips of the sheet punched by the punch mechanism 38*a*.

The configuration of the punch mechanism 38*a* will be described below. The punch mechanism 38*a* is a general mechanism obtained by combining a rotating eccentric cam and a punch blade, and thus illustration thereof is omitted. A punch member having the punch blade (punch) and a die member having a blade receiving hole are disposed opposite to each other through the sheet conveying path in the punch unit 30. The punch member is bearing-supported to a unit frame so as to be vertically movable at a predetermined stroke and is connected with a vertically moving punch drive unit.

The punch drive unit includes a drive motor and a drive cam connected thereto. The drive cam is an eccentric cam and is linked to the punch member. The drive motor driver of the punch drive unit is connected to a not-shown controller and is controlled thereby. The punch mechanism 38*a* adopts a shift mechanism that reciprocatively moves one or a plurality of punch members at a predetermined stroke from the top dead center to the bottom dead center, and the shift mechanism is constituted of a drive cam and a drive motor. Alternatively, the punch mechanism may adopt a mechanism (rotary punch mechanism). In this mechanism, projecting punch members integrally formed around a rotating body punch a file hole in a sheet passing therethrough while being rotated.

[Relay Conveying Unit]

The sheet that has passed through the sheet conveying path in the punch unit 30 is received by a first relay conveying roller pair 34 in the relay conveying unit 31 to be fed to a first conveying path 131. The sheet on the first conveying path 131 is conveyed to the sheet binding unit 32, or to the second conveying path 133, along which the sheet is conveyed to the second stack tray 141 (through a third conveying path 139) or discharge box 142. The first conveying path 131 in the relay conveying unit 31 is provided with the first relay conveying roller pair 34 and a second relay conveying roller pair 35. The first relay conveying roller pair 34 and the second relay conveying roller pair 35 are arranged spaced apart from each other at substantially horizontal positions. The distance between the first relay conveying roller pair 34 and the second relay conveying roller pair 35 is set substantially equal to the distance between the first main body discharge roller 14 and the first relay conveying roller pair 34 and to the distance between the second relay conveying roller pair 35 and a carry-in roller pair 51 provided in the sheet binding unit 32 and smaller than the minimum sheet length in the sheet conveying direction of various sheets used in the image forming unit A.

A first path switching member 132 is provided between the first and second relay conveying roller pairs 34 and 35 in the first conveying path 131. The first path switching member 132 guides the sheet conveyed from the first relay conveying roller pair 34 to the second relay conveying roller pair 35 in a state of being at a first position (a state where the first path switching member 132 in FIG. 2 swings in the clockwise direction by a predetermined amount), while guiding the sheet conveyed from the first relay conveying roller pair 34 to the second conveying path 133 in a state of being at a second position (a state where the first path switching member 132 in FIG. 2 swings in the counterclockwise direction by a predetermined amount). The sheet conveyed to the second conveying path 133 is conveyed by a plurality of roller pairs 134, 135, and 136 to be discharged to the second stack tray 141 or discharge box 142. Further, a second path switching member 138 is provided between the conveying roller pair 136 and a conveying roller pair 137 in the second conveying path 133 and switches the sheet conveying destination between the third conveying path 139 and the conveying roller pair 137 side.

When the sheet is discharged to the second stack tray 141 by the second path switching member 138, the sheet passes through the third conveying path 139 to be discharged by a discharge roller pair 140 provided at a second discharge port 140*a*. The second stack tray 141 has a sheet stacking surface larger in length in the sheet conveying direction than the first stack tray 26 and is thus suitable for receiving a long sheet. A long sheet may be discharged to the third stack tray 27; however, if the front end of the long sheet that has been discharged to the third stack tray 27 protrudes from the third stack tray 27 to hang over the first stack tray 26, discharge of sheets that have been processed in the sheet binding unit 32 to the first stack tray 26 may be hampered. Thus, a long sheet having a length exceeding the length of the sheet stacking surface of the third stack tray 27 is preferably discharged to the second stack tray 141. Although the second stack tray 141 is fixedly provided below the first stack tray 26 configured to be elevated/lowered in the present embodiment, it may be provided with an elevating/lowering mechanism to be elevated/lowered, like the first stack tray 26.

When the sheet is discharged to the discharge box 142, the sheet is conveyed forward along the second conveying path 133 and discharged from the conveying roller pair 137. The discharge box 142 has a simple box shape, and the sheet discharged from the conveying roller pair 137 falls freely into the discharge box 142. The discharge box 142 has an opening/closing cover 143, and an operator can take out the sheet stored in the discharge box 142 by opening the opening/closing cover 143. The discharge box 142 can receive and store a long sheet like the second stack tray 141 and can serve also as an escape box for an error sheet. Further, when the discharge box 142 is used for confidential documents, a key may be attached to the opening/closing cover 143 so as to allow only specific persons to access the discharge box 142.

The relay conveying unit 31 according to the present embodiment has the second conveying path 133 in addition to the conventionally provided first conveying path 131. The second conveying path 133 branches (see reference numeral 133*a* in FIG. 2) downward (toward the image forming part 2) from the first conveying path 131, extends (see reference numeral 133*b* in FIG. 2) in substantially the horizontal direction (in substantially parallel to an in-body installation surface 36) between the in-body installation surface 36 of the image forming part 2 and the sheet binding unit 32, and extends (see reference numeral 133*c* in FIG. 2) therefrom in substantially the vertical direction along an image forming unit side surface 90. In other words, substantially the front half of the second conveying path 133 branching from the first conveying path 131 extends while bending at substantially 90° so as to surround the in-body installation surface 36 and image forming unit side surface 90 below the sheet binding unit 32 in the vertical direction.

Further, the second conveying path 133 is partially openable (see reference numeral 133*a*) for jam clearance, thus facilitating removal of a jammed sheet.

[Sheet Binding Unit]

Figure 2:
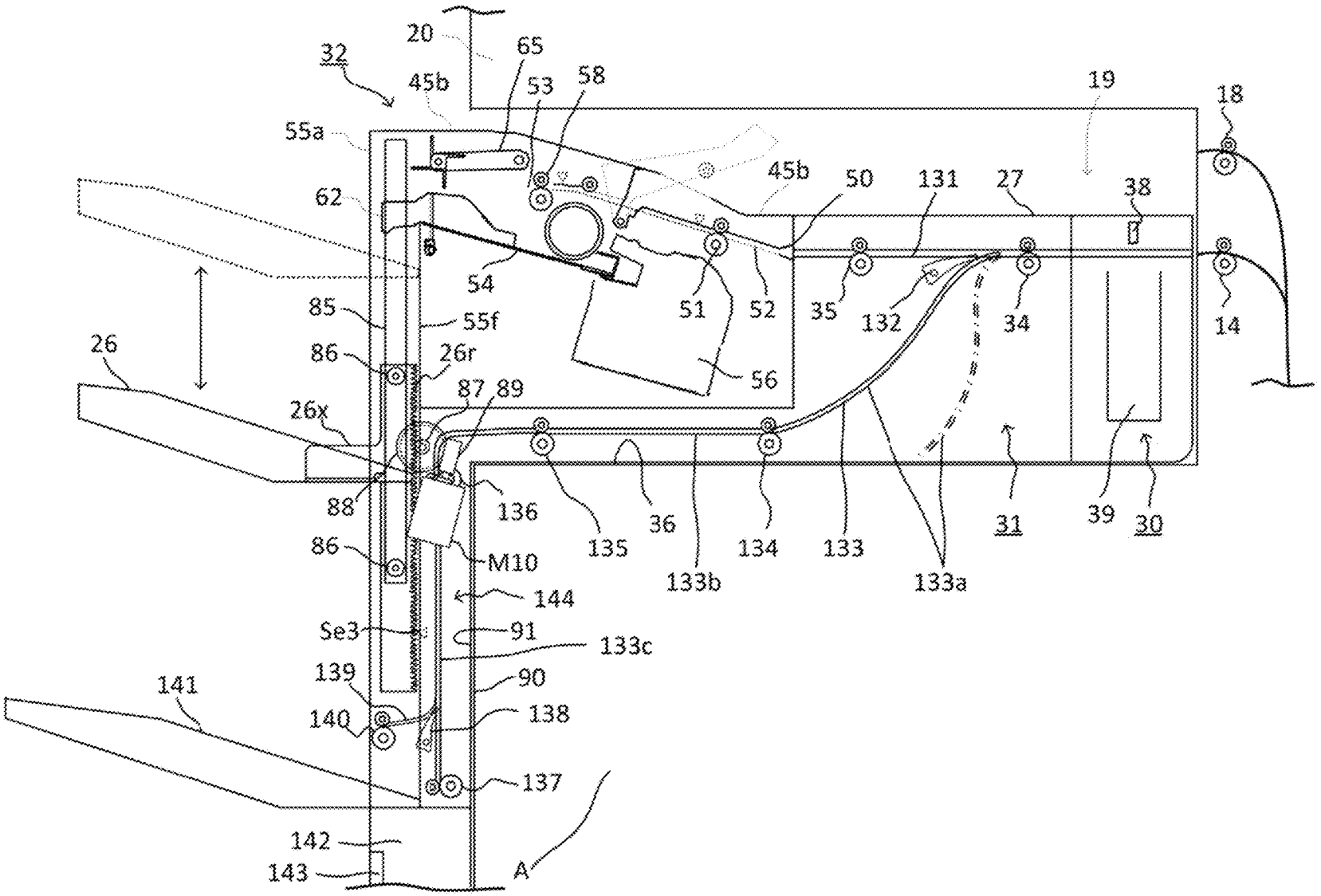
FIG. 2 is a side-face cross-sectional view (a front side of the image forming apparatus) illustrating details of the relay conveying unit and a sheet binding unit.
Figure 3:
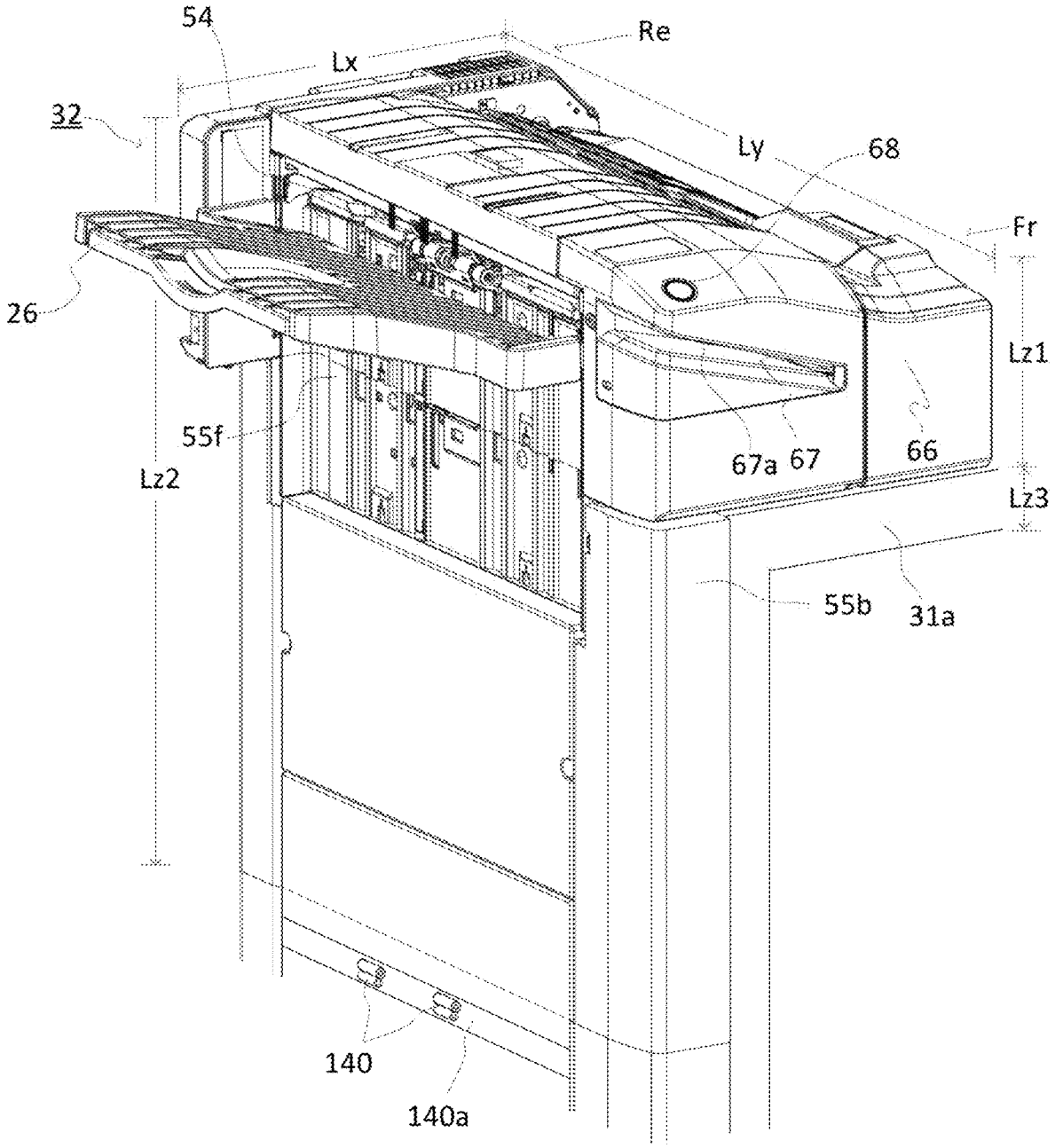
FIG. 3 is a perspective explanatory view illustrating the entire configuration of a sheet processing apparatus illustrated in FIG. 1.

As illustrated in FIG. 3, which is a perspective of the entire sheet processing apparatus and FIG. 2, which is a cross-sectional view thereof, the sheet binding unit 32 includes a unit housing 55, a sheet carry-in path 52 disposed in the housing 55, a processing tray 54 disposed downstream from the sheet carry-in path 52 in the sheet conveying direction, and a first stack tray 26 disposed downstream from the processing tray 54 in the sheet conveying direction.

The processing tray 54 is provided with a sheet carry-in unit 65 for carrying in sheets, a sheet end regulating unit 61 for accumulating the carried-in sheets in a bundle, and a sheet aligning unit 62 for aligning the sheets accumulated in a bundle by tapping them from a direction perpendicular to the sheet conveying direction. The processing tray 54 is further provided with a staple binding unit 56 (first binding unit) for binding an aligned sheet bundle with a staple and a stapleless binding unit 57 (second binding unit) for binding an aligned sheet bundle without a staple.

The unit housing 55 is constituted of a unit frame 55*a* and an outer casing 55*b*. The unit frame 55*a* has a frame structure that supports mechanism parts (a path mechanism, a tray mechanism, a conveying mechanism, etc.) to be described later. The unit shown has a monocoque structure in which a binding mechanism, a conveying mechanism, a tray mechanism, and a drive mechanism are disposed between a pair of opposing side frames (not shown) and are integrated with the outer casing 55*b*. The outer casing 55*b* is formed in a monocoque structure in which a pair of side frames 55*c* and 55*d* and a stay frame connecting the side frames are integrated by, e.g., resin molding, and a part (unit front side) thereof is exposed so as to be operable from outside.

The sheet binding unit 32 has the above configuration, that is, the outer periphery of the frame thereof is covered with the outer casing 55*b*, and only a sheet binding mechanism part is incorporated in the in-body sheet discharge space 19 of the image forming unit A (that is, the first stack tray 26, a guide part arranged around the first stack tray 26, and a drive part are exposed therefrom). In this state, a part of the outer casing 55*b* on the apparatus front side Fr is exposed so as to be operable from outside. The outer casing 55*b* is provided with, on its apparatus front side Fr, a staple exchange cover 66, a manual feed setting part (insertion part), and a manual operation button 68 (the one illustrated is a switch incorporating a display lamp) which are to be described later.

A length Lx of the outer casing 55*b* in the sheet conveying direction and a length Ly thereof in a direction perpendicular to the sheet conveying direction are set based on the maximum size of a sheet that can be handled by the sheet binding unit 32 and are set smaller than the lengths of the in-body sheet discharge space 19 of the image forming unit A in those directions. Further, a length Lz in the vertical direction (gravity direction) of the outer casing 55*b* in an installation state is set such that a length obtained by adding a length Lz1 of a portion where a processing part including the staple binding unit 56, stapleless binding unit 57, and the like and a length Lz3 of an outer cover 31*a* covering a part of the relay conveying unit 31 that is disposed below the sheet binding unit 32 is set smaller than the vertical length of the in-body sheet discharge space 19 of the image forming unit A and that a length Lz2 of a portion where the first stack tray 26, the guide part disposed around the first stack tray 26, and the drive part are arranged is set so as to correspond to the sheet stacking amount of the first stack tray 26, i.e., the moving amount of the first stack tray 26 determined by the maximum sheet stacking amount.

[Sheet Conveying Path]

As illustrated in FIG. 3, the unit housing 55 is provided with the sheet carry-in path 52 having a carry-in port 50. The illustrated sheet carry-in path 52 horizontally receives a sheet from the first conveying path 131 of the relay conveying unit 31, conveys the sheet substantially horizontally (in a direction slightly inclined upward in the sheet conveying direction), and carries out the sheet from a sheet discharge port 53. The sheet carry-in path 52 is formed of an appropriate paper guide (plate) 52*a* and incorporates a conveying mechanism for sheet conveyance. The conveying mechanism is constituted by conveying roller pairs arranged at a predetermined interval according to the path length. Specifically, as illustrated, a carry-in roller pair 51 is provided in the vicinity of the carry-in port 50, and a discharge roller pair 58 is provided in the vicinity of the sheet discharge port 53. The sheet carry-in path 52 is further provided with sheet sensors Se1 and Se2 for detecting the front end and/or rear end of the sheet.

The above sheet carry-in path 52 is constituted by a substantially horizontally extending linear path that crosses the unit housing 55. This is because a curved path may apply unnecessary stress on a sheet to be conveyed, and the path is made linear as much as possible within an allowable range of unit layout. The above carry-in roller pair 51 and discharge roller pair 58 are both connected to a not-shown drive motor M1 (hereinafter, referred to as "conveying motor") and convey a sheet at the same peripheral speed.

[Processing Tray]

Referring back to FIG. 3, the processing tray 54 is disposed at the sheet discharge port 53 of the sheet carry-in path 52 with a level difference formed downstream from the sheet discharge port 53 in the sheet conveying direction. The processing tray 54 is provided with a sheet placing surface 54*a* that supports at least a part of a sheet so as to vertically accumulate sheets fed from the sheet discharge port 53 in a bundle. In the illustrated configuration, a structure (bridge support structure) is adopted, in which the sheet front end side is supported by the first stack tray 26 to be described later, and the sheet rear end side is supported by the processing tray 54. This reduces the size of the tray.

The above processing tray 54 accumulates sheets fed from the sheet discharge port 53 in a bundle, binds the accumulated sheet after aligning the sheets to a predetermined posture, and carries out the bound sheet bundle to the first stack tray 26 on the downstream side in the sheet conveying direction. To this end, the processing tray 54 incorporates therein the sheet carry-in unit 65, sheet aligning unit 62, staple binding unit 56, stapleless binding unit 57, and a sheet bundle carry-out unit 70.

The configurations and control mechanisms of the above processing tray 54, sheet carry-in unit 65, sheet aligning unit 62, staple binding unit 56, and stapleless binding unit 57 have been disclosed in JP2019-139054A, and similar configurations and control mechanisms are adopted in the present embodiment, so detailed description thereof will be omitted.

[First Stack Tray]

Figure 4:
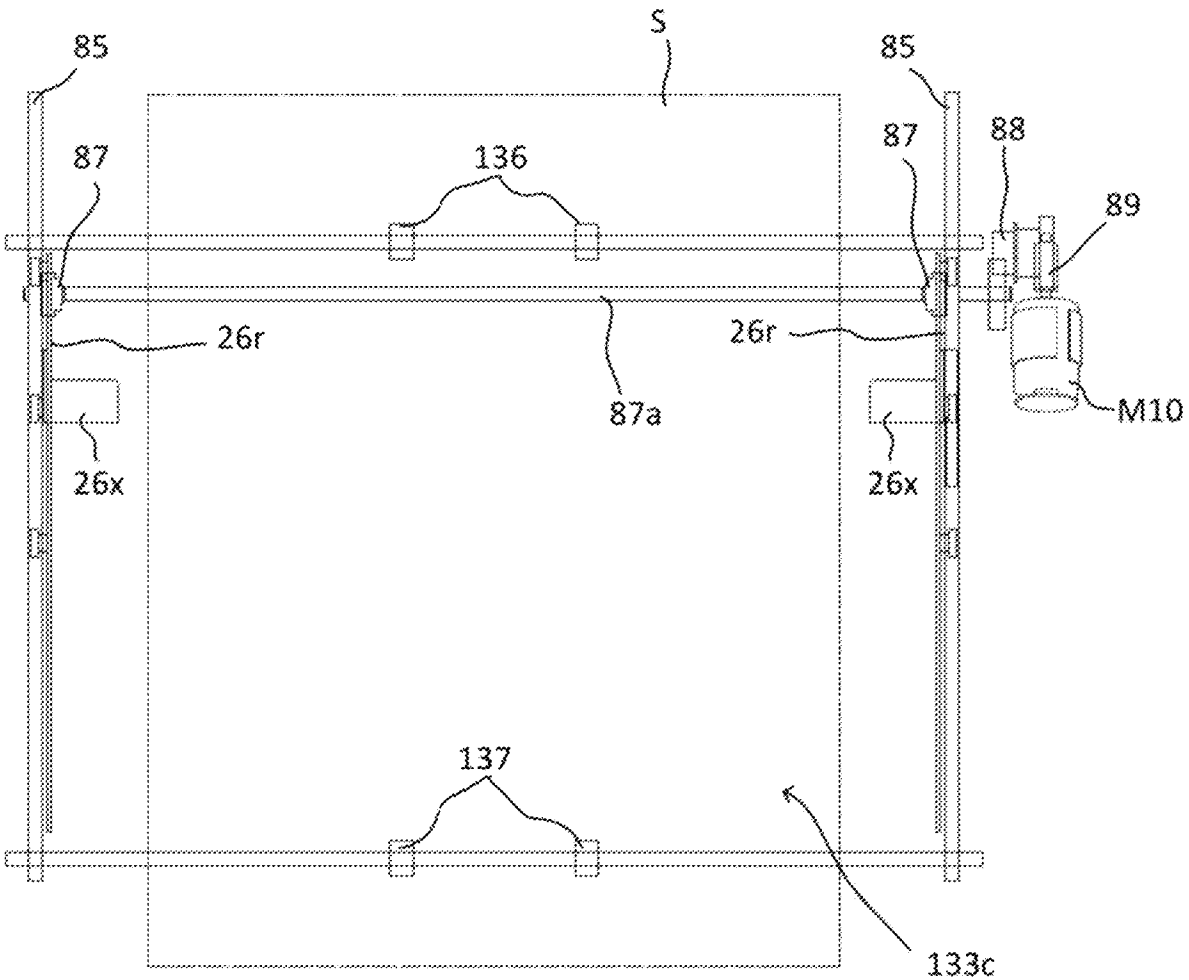
FIG. 4 is an arrangement explanatory view (viewed from a side-face of the image forming apparatus) of a drive mechanism of elevating/lowering of a first stack tray and a second conveying path.

The configuration of the first stack tray 26 will be described based on FIGS. 2 and 4. The first stack tray 26 is disposed downstream from the processing tray 54 in the sheet discharge direction and stacks thereon the sheet bundle processed on the processing tray 54 for storage. The first stack tray 26 is provided with a mechanism for elevating/lowering the tray 26 such that the tray 26 is lowered in accordance with the stacking amount of sheets. The stacking surface (surface of the uppermost sheet) of the first stack tray 26 can be elevated to a height position substantially flush with the sheet placing surface 54*a* of the processing tray 54.

The mechanism for elevating/lowering the first stack tray 26 will be described concretely below. The unit frame 55*a* is fixed with an elevating rail 85 extending in the stacking direction (vertical direction) of the sheet bundle. The end portion of the first stack tray 26 on the upstream side in the sheet discharge direction is fixed to a tray base 26*x*. The tray base 26*x* is fixed with two slide rollers 86 which are rotatably axially supported at positions vertically sandwiching the fixed position of the first stack tray 26. The outer periphery of each of the slide rollers 86 and the elevating rail 85 are slidably fitted to each other.

Further, a rack 26*r* is integrally formed with the tray base 26*x* so as to extend in parallel to the tray base 26*x* in the elevating/lowering direction. The rack 26*r* is engaged with a gear tooth formed in a drive pinion 87 axially supported by the unit frame 55*a*. Further, a worm wheel 88 is integrally formed with the drive pinion 87 so as to surround the outer periphery of the drive pinion 87. The worm wheel 88 is connected to an elevating motor M10 through a worm gear 89. The elevating motor M10 is also fixed to the unit frame 55*a*.

Thus, when the elevating motor M10 is rotated normally and reversely, the rack 26*r* connected to the drive pinion 87 is moved upward and downward with respect to the unit frame 55*a*. In this mechanism, the tray base 26*x* is vertically moved while supporting the end portion of the first stack tray 26 on the upper stream side in the sheet discharge direction in a cantilever manner. Although a mechanism using the rack and pinion is used as the mechanism for elevating/lowering the tray in the example of FIG. 2, another mechanism that elevates/lowers the tray using a belt and pulley system can be adopted, in which a belt is wound on a pulley and the pulley is driven by a motor connected thereto.

The stacking surface of the first stack tray 26 integrally mounted to the tray base 26*x* is inclined at a predetermined angle (e.g., 20° to 60°) such that the upstream side in the sheet discharge direction is lowered so as to allow the sheet bundle to abut against a tray aligning surface 55*f* at its rear end in the sheet discharge direction by its own weight.

The elevating rail 85 that guides the movement of the tray base 26*x* extends in the elevating/lowering direction of the first stack tray 26 straddling the in-body installation surface 36 on which a part of the sheet binding unit 32 inside the in-body sheet discharge space 19 is installed. This allows the first stack tray 26 to be lowered below the in-body installation surface 36, making it possible for sheets to be stacked in a wider vertical range than the in-body sheet discharge space 19.

A drive part for elevating/lowering the tray, which is constituted of the drive pinion 87 integrally having the worm wheel 88 and the elevating motor M10 having the worm gear 89, is disposed below the in-body installation surface 36 on which a part of the sheet binding unit 32 inside the in-body sheet discharge space 19 is installed. Further, the drive part is disposed on the side surface of the outer casing of the image forming unit A at a portion to which the unit frame 55*a* extends in the elevating/lowering direction of the first stack tray 26.

As a result, as compared to a case where the drive part is disposed above the in-body installation surface 36, a range in which the first stack tray 26 is elevated/lowered by a combination of one elevating motor M10 and the rack 26*r* can be easily extended. Further, the lower limit position is set for the first stack tray 26 so as not to allow abnormal lowering of the tray, and a limit sensor Se3 for detecting the tray is disposed at the lower limit position.

In the drive part for elevating/lowering the first stack tray 26, the first stack tray 26 positioned on the most downstream side in the sheet discharge direction, the tray base 26*x* fixing the first stack tray 26, and the rack 26*r* formed at a part of the tray base 26*x* opposite to the first stack tray 26 are arranged in this order from the downstream side in the sheet discharge direction. Accordingly, the drive part is disposed below a part of a second binding unit cover 45*b* that extends outside the unit body and between the rack 26*r* formed in the tray base 26*x* and the outer casing 55*b* extending along the side surface of the image forming unit A.

The elevating motor M10 is disposed between the rack 26*r* and the outer casing 55*b* extending along the side surface of the image forming unit A with the rotary axis thereof inclined at a predetermined angle with respect to the extending direction of the side surface 90 of the image forming unit A and is fixed to the unit frame 55*a*. As a result, as compared to a case where the rotary axis of the motor M10 is disposed parallel to the extending direction of the side surface 90 of the image forming unit A, the elevating motor M10 can be disposed in a reduced space.

By obliquely disposing the elevating motor M10, the worm gear 89 fixed to the motor shaft and rotated together therewith approaches the outer casing 55*b*. When the sheet binding unit 32 is mounted in the image forming unit A using a surface on which a sheet is delivered from the relay conveying unit 31 to the sheet binding unit 32 as a reference, a part of the outer casing 55*b* extending in the elevating/lowering direction of the first stack tray 26 is bent, which may cause the outer casing 55*b* and the worm gear 89 to interfere with each other.

Thus, an extension surface 91 of the outer casing 55*b* extending in the elevating/lowering direction of the first stack tray 26 that contacts the side surface 90 of the image forming unit A is used as a regulating surface for positioning at installation. As a result, the fixing position of the sheet binding unit 32 to the image forming unit A is regulated by the extension surface 91 of the outer casing positioned close to the drive part, preventing interference between the outer casing 55*b* and the worm gear 89.

Here, the arrangement relationship between the second conveying path 133 and the above mechanism for elevating/lowering the first stack tray 26 will be described. The elevating rails 85 are provided at the front and rear sides of the sheet processing apparatus and are connected through a shaft 87*a* supporting the drive pinion 87. The distance between the front-side elevating rail 85 and the rear-side elevating rail 85 is set larger than the length of a sheet S with a maximum size in the width direction (direction perpendicular to the sheet conveying direction).

A part 133*c* (the part between the conveying roller pair 136 and the conveying roller pair 137) of the second conveying path 133 is disposed in a space part 144 between the elevating rail 85 (movement trajectory of the tray base 26*x* of the first stack tray 26) and the side surface 90 of the image forming unit A. Within this space part 144, the drive part for elevating/lowering the first stack tray 26, including the elevating motor M10, rack 26*r*, and drive pinion 87, is provided outside (at the front side of) the part 133*c* of the second conveying path 133 in the sheet width direction. In other words, the part 133*c* (part between the conveying roller pair 136 and the conveying roller pair 137) of the second conveying path 133 and the drive part for elevating/lowering the first stack tray 26 are disposed in the space part 144 between the elevating rail 85 (movement trajectory of the tray base 26*x* of the first stack tray 26) and the side surface 90 of the image forming unit A so as to overlap each other in the sheet width direction. This can reduce the distance between the elevating rail 85 and the side surface 90 of the image forming unit A, which in turn can reduce the apparatus size.

[Operation Part]

The operation part 42 illustrated in FIG. 1 includes an operation input part 42*a* that receives an input with respect to the image reading unit C, image forming unit A, and sheet post-processing unit B and an operation display part 42*b* that displays and outputs various information items. In this image forming apparatus, a substantially plate-like operation panel part 42*c* is provided. The operation panel part 42*c* has, at its front side, a touch panel. The touch panel is constituted by embedding, e.g., a piezoelectric sensor in a liquid crystal display panel and is configured to display various information items and receive an operation input from an operator. For example, the touch panel displays a menu screen. The operator can set various operation contents of the image forming apparatus by touching a button (button-shaped image) virtually arranged in the touch panel. The touch panel functions both as a part of the operation input part 42*a* and a part of the operation display part 42*b*.

The operation part 42 is provided in a casing formed integrally with the outer casing of the image reading apparatus 20 or fixed to the outer casing of the image reading apparatus 20 through a turnable mounting tool such as a hinge. In either of the described configurations, the operation part 42 protrudes from the front side of the image reading apparatus 20 to be disposed at a position overlapping the first discharge port 40 and third discharge port 41 on the side at which the document stacker 25 of the image reading unit C is disposed.

[Second Stack Tray]

The third stack tray 27 provided above the sheet post-processing unit B will be described using FIG. 2. The third stack tray 27 is constituted by continuous arrangement of a punch unit cover 43, a relay unit cover 44, and binding unit cover 45 which are outer casings provided at the topmost positions of the respective punch unit 30, relay conveying unit 31, and sheet binding unit 32 which are disposed in the in-body sheet discharge space 19.

The punch unit cover 43 and relay unit cover 44 are each formed into a flat surface horizontally extending in the sheet discharge direction. Accordingly, the distance between the punch unit cover 43 and a bottom surface 20*a* of the image reading apparatus 20 disposed above the relay unit cover 44 is kept substantially constant.

The binding unit cover 45 keeps a horizontal shape continuing from the relay unit cover 44 around the carry-in port 50 adjacent to the relay unit cover 44, then inclined upward from a portion upstream relative to the carry-in roller pair 51 in the sheet discharge direction, and then becomes a horizontally extending flat surface once again at a portion downstream from the discharge roller pair 58 in the sheet discharge direction. The flat surface extends from the inside of the body to the outside thereof from the in-body sheet discharge space 19 positioned inside the body of the image forming apparatus toward a portion above the first stack tray 26 positioned outside the body of the image forming apparatus.

The third discharge port 41 at which a sheet is discharged from a second main body discharge roller pair 18 of the image forming unit A is disposed spaced apart from the bottom surface 20*a* of the image reading apparatus 20 at a distance d1. The upper surfaces of the respective punch unit cover 43 and relay unit cover 44 are spaced apart from the bottom surface 20*a* of the image reading apparatus 20 at a distance d2. The distances d1 and d2 are set so as to satisfy d1<d2. Thus, a level difference is formed between the third discharge port 41 and the upper surfaces of the respective punch unit cover 43 and relay unit cover 44, allowing a sheet carried out from the third discharge port 41 to be stacked.

The binding unit cover 45 is constituted of a first binding unit cover 45*a* (openable cover) having one end as the carry-in port 50 and a second binding unit cover 45*b* having a portion extending above the first stack tray 26 positioned outside the in-body sheet discharge space 19. The first binding unit cover 45*a* is turnably mounted with a cover shaft 82 fixed to the unit frame 55*a* as a fulcrum so as to open the carry-in port 50 side of the sheet carry-in path 52. That is, the turning area of the first binding unit cover 45*a* serves also as the sheet stacking space of the second stack tray.

The carry-in roller pair 51 is constituted of a drive-side carry-in roller 51*a* (drive roller) and a driven-side carry-in roller 51*b* (driven roller) driven so as to follow the carry-in roller 51*a*. The carry-in roller 51*b* is rotatably axially supported by the first binding unit cover 45*a* and is biased by a not-shown elastic member toward the carry-in roller 51*a*. When the first binding unit cover 45*a* is opened upward, the carry-in roller 51*b* supported by the cover 45*a* is moved upward together with the first binding unit cover 45*a*, so that nip of the carry-in roller pair 51 is released.

When abnormal stop of conveyance (hereinafter, referred to as "JAM") occurs due to some cause after the release of the nip of the carry-in roller pair 51 between the second relay conveying roller pair 35 of the relay conveying unit 31 and the carry-in roller pair 51 of the sheet binding unit 32, it is possible to easily access the JAM sheet, allowing the operator to remove the sheet jammed in the sheet carry-in path 52.

Further, also when the JAM occurs between the carry-in roller pair 51 and the discharge roller pair 58 of the sheet binding unit 32, it is possible to easily access and remove the JAM sheet. The end portion of the first binding unit cover 45*a* on the carry-in port 50 side is positioned downstream so as to be spaced apart at a predetermined distance from the end portion of the operation part 42 on the downstream side in the sheet discharge direction. Specifically, in FIG. 2, a distance d4 from one end portion of the operation part 42 to the carry-in port 50 is set to about 50 mm to about 70 mm. This allows easy access to the opening of the first binding unit cover 45*a*.

Further, the cover shaft 82 serving as the turning fulcrum of the first binding unit cover 45*a* is located at a position higher than the one end of the first binding unit cover 45*a* on the carry-in port 50 side. This level difference allows the one end of the first binding unit cover 45*a* on the carry-in port 50 side to be opened wide with a small turning angle of the first binding unit cover 45*a*. This allows easy access to the JAM sheet in the sheet carry-in path 52.

The second binding unit cover 45*b* is constituted of a part inclined at the same angle as the inclination angle of the first binding unit cover 45*a* and a part having a flat surface substantially horizontally extending downstream from the discharge roller pair 58 in the sheet discharge direction. The flat surface is located spaced apart from the bottom surface 20*a* of the image reading apparatus 20 at a distance d3. That is, the third stack tray 27 has a surface on which a sheet can be stacked extending from the inside to the outside of the body of the apparatus in the sheet discharge direction, so that it can stack and retain thereon a sheet longer than a sheet that can be stacked on the first stack tray 26 When a long sheet whose front end reaches the first stack tray 26 is discharged to the second stack tray 141 or discharge box 142.

[Staple Exchange Cover]

The sheet binding unit 32 has, as the mechanisms for binding processing, the first binding unit 56 that binds a sheet bundle using a staple and the second binding unit 57 that crimps and deforms a sheet bundle to bind it without a staple. The first binding unit 56 performs binding using a staple, so that there occurs a need to replenish staples after the staples are used up.

For the replenishment of the staples, the first binding unit 56 is moved to a manual binding position Mp by a not-shown drive unit and rotated by a predetermined angle toward a staple exchange cover 66. The staple exchange cover 66 is axially supported by a staple exchange cover shaft 66*x* and turnably fixed to the outer casing 55*b* with one end of the sheet binding unit 32 on the carry-in port 50 side (on the downstream) side in the sheet discharge direction) as an opening.

As in the case of the first binding unit cover 45*a*, one end of the staple exchange cover 66 on the downstream side in the sheet discharge direction is positioned spaced apart on the downstream side from the end portion of the operation part 42 on the downstream side in the sheet discharge direction at a predetermined distance (distance d4). This prevents the operation part 42 from interfering with the replenishment of staples, ensuring easy access to the staple exchange cover 66 at the replenishment.

Other Embodiments

In the above embodiment, the sheet conveyed to the second conveying path 133 is discharged directly to the second stack tray 141 or discharge box 142; however, the present invention is not limited to this configuration, but various other configurations may be adopted as follows. In the following, the same parts and components are denoted by the same reference numerals and detailed description thereof will be omitted.

Figure 5:
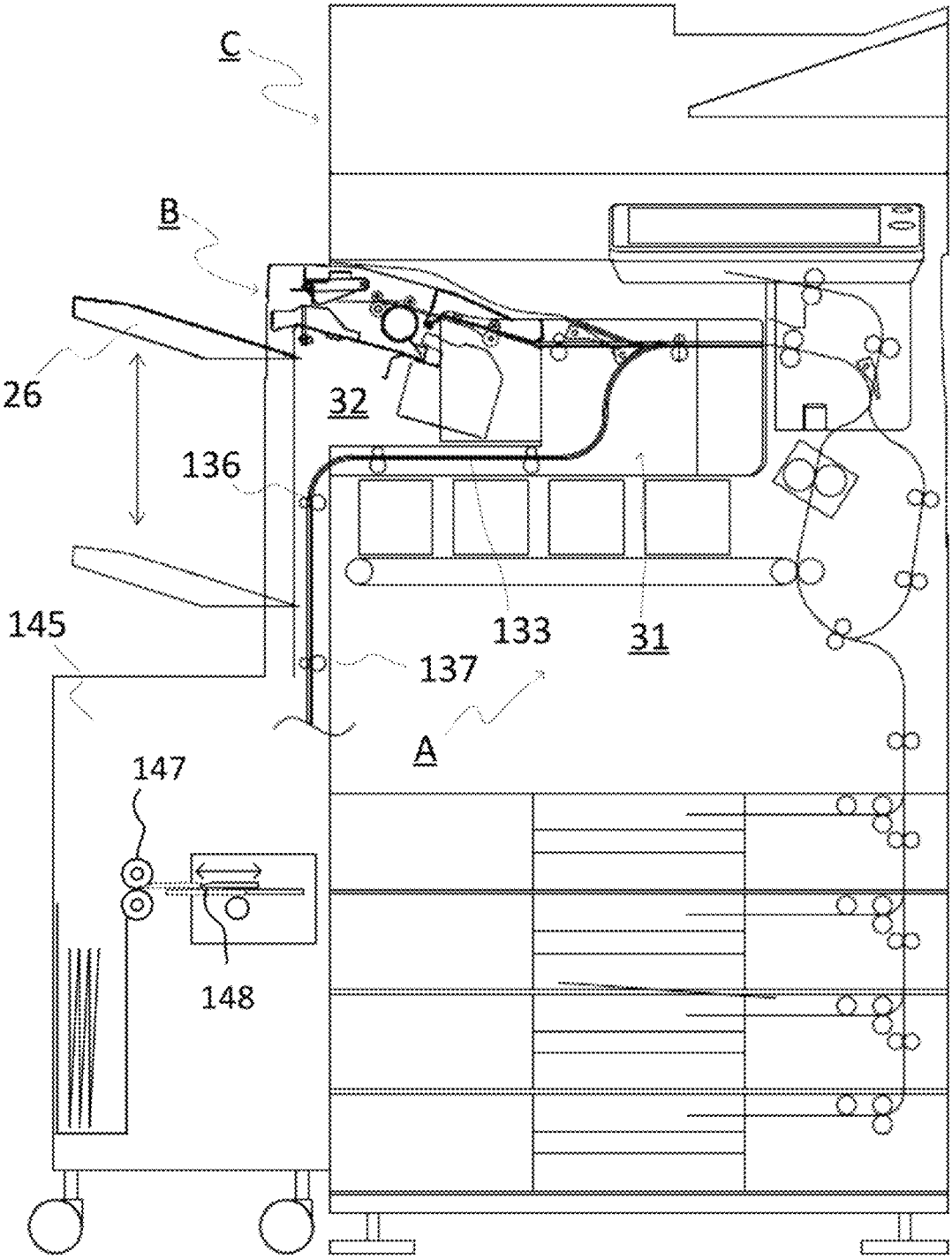
FIG. 5 is an explanatory view of another embodiment of the relay conveying unit according to the present invention.

For example, as illustrated in FIG. 5, a sheet folding unit 145 that applies folding to the sheet may be provided downstream from the conveying roller pair 137. Conventionally, as disclosed in JP2017-114648A, a post-processing apparatus including a sheet binding unit and a sheet folding unit is connected to an image forming apparatus having no in-body discharge space, while in the configuration illustrated in FIG. 5, the sheet binding unit 32 is disposed in the in-body sheet discharge space 19 of the image forming apparatus, and the sheet folding unit 145 is disposed below the first stack tray 26, so that the entire size can be made compact. The configuration and control mechanism of the sheet folding unit 145 have been disclosed in JP2017-114648A, so detailed description thereof will be omitted.

Figure 6:
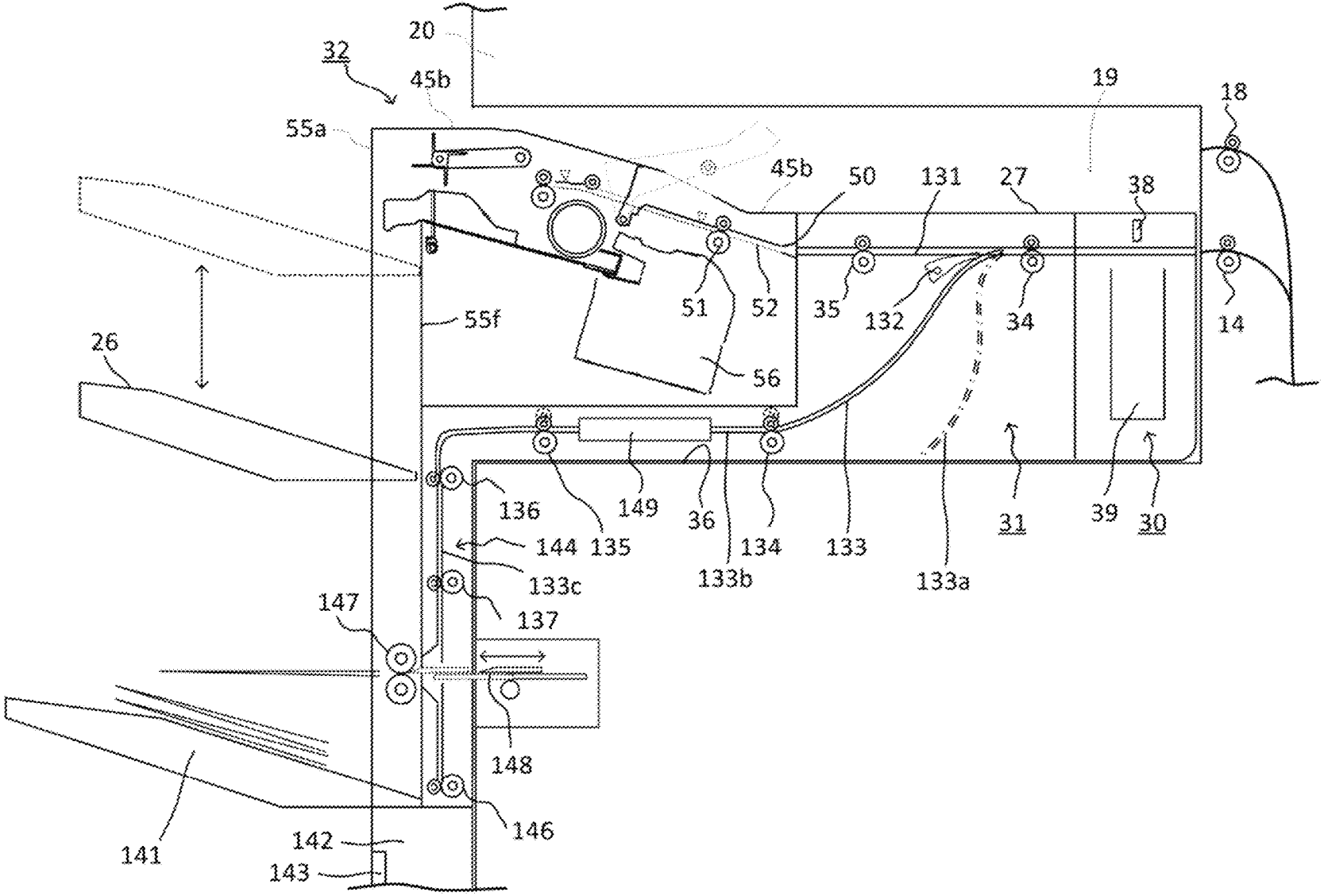
FIG. 6 is an explanatory view of another embodiment of the relay conveying unit according to the present invention.

Further, a configuration as illustrated in FIG. 6 may be adopted, in which another conveying roller pair 146 is provided downstream from the conveying roller pair 137, and a folding roller pair 147 for folding the sheet is provided between the conveying roller pair 137 and the conveying roller pair 146, and a pushing plate 148 for pushing a sheet surface is provided between the image forming part 2 and the sheet feed part 1. Specifically, in this configuration, the surface of the sheet conveyed to the second conveying path 133*c* is pushed by the pushing plate 148 to guide the sheet surface to the folding roller pair 147. Then, the sheet is subjected to folding by the folding roller pair 147, and the resultant sheet is discharged to the second stack tray 141.

In this embodiment, the skew of the sheet conveyed to the second conveying path 133 needs to be corrected for the subsequent folding processing. To this end, the conveying roller pair 134 and conveying roller pair 135, which are disposed at the horizontal part 133*b* of the second conveying path 133, are each made movable between a nip position for nipping the sheet for conveyance and a separation position for releasing the nip of the sheet, and a width aligning member 149 that pushes the end edges of the sheet from both sides in the sheet width direction for sheet alignment is disposed between the conveying roller pairs 134 and 135. With this configuration, sheet conveyance is temporarily stopped in a state where the conveyed sheet is nipped by the conveying roller pairs 134 and 135, and then the conveying roller pairs 134 and 135 are moved to the separation position. In this state, the sheet is aligned in the width direction by the width aligning member 149, and then the conveying roller pairs 134 and 135 are moved to the nip position, followed by resuming the sheet conveyance. The thus aligned sheet is subjected to folding using the pushing plate 148 and the folding roller pair 147, so that sheet folding quality is improved.

Figure 7:
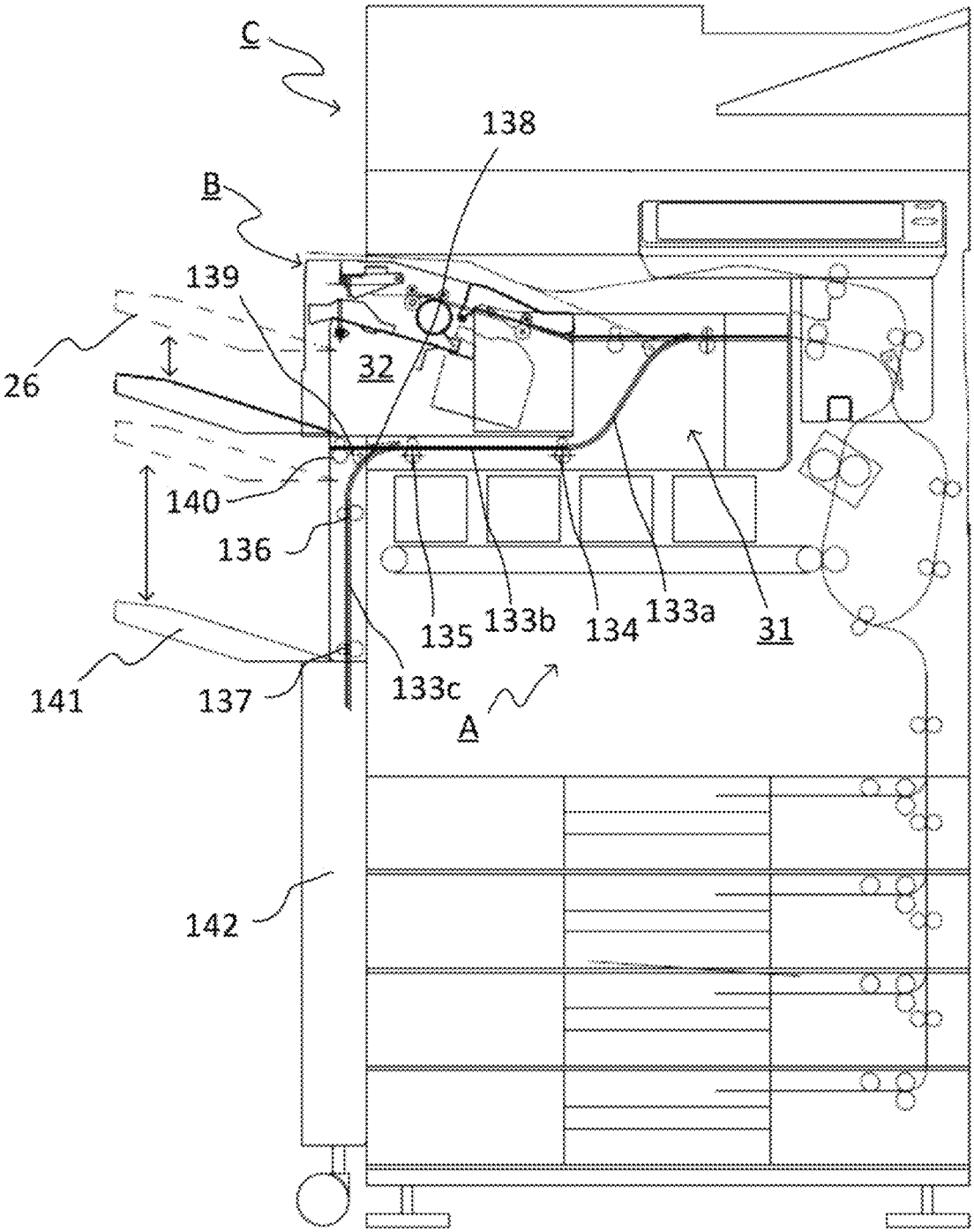
FIG. 7 is an explanatory view of another embodiment of the relay conveying unit according to the present invention.

Further, as illustrated in FIG. 7, the second path switching member 138 may be provided between the conveying roller pairs 135 and 136 (between the sheet binding unit 32 and the in-body installation surface 36) so as to make the third conveying path 139 extend in a direction parallel to the in-body installation surface 36 (i.e., extension of the horizontal part 133*b* of the second conveying path 133). Although the moving amount of the first stack tray 26 is reduced, the second stack tray 141 is also made movable to a certain degree.

In the above embodiment, the distance between the conveying roller pairs disposed in the second conveying path 133 is larger than the distance between the conveying roller pairs disposed in the first conveying path 131. However, there may be cases where a sheet other than a long sheet is conveyed along the second conveying path 133, so that the distance between the conveying roller pairs disposed in the second conveying path 133 is set smaller than the length of a sheet with a minimum size.

Further, in the above embodiment, the punch unit 30 is provided between the relay conveying unit 31 and the first discharge port 40; alternatively, however, a configuration may be possible in which the sheet is conveyed directly to the relay conveying unit 31 without providing the punch unit 30. In this case, the punching unit 38 and the punch waste box 39 are detachably attached, as one unit, to the position corresponding to the punch unit 30.

Further, in the above embodiment, the sheet binding unit 32 is provided as the sheet processing apparatus; however, various other processing apparatuses, such as a folding unit, a sorting unit, a punching unit, that discharge a final product to the first stack tray 26 may be provided as the sheet processing apparatus.

This application is based upon and claims the benefit of priority from prior Japanese Patent Application No. 2020-019918, the entire contents of which are incorporated herein by reference.

The invention claimed is:

1. An image forming apparatus comprising:

an image reading part for reading an image;

an image forming part disposed vertically below the image reading part and configured to form an image on a sheet;

an in-body space part provided between the image reading part and the image forming part;

a sheet processing apparatus including a sheet processing part provided inside the in-body space part between the image reading part and the image forming part and configured to apply predetermined processing to sheets, and a first stacking part disposed adjacent to the sheet processing part and outside the in-body space part and configured to stack thereon the sheets processed by the sheet processing part;

a first discharge part for discharging the sheet on which an image is formed by the image forming part to the in-body space part;

a second discharge part provided outside the in-body space part and vertically below the first stacking part and configured to discharge the sheet; and a relay conveying unit including a first conveying path for conveying the sheet discharged from the first discharge part toward the sheet processing apparatus, and a second conveying path extending between the sheet processing apparatus in the in-body space part and the image forming part and configured to convey the sheet discharged from the first discharge part toward the second discharge part.

2. The image forming apparatus according to claim 1, wherein the second discharge part is disposed vertically below a part of the second conveying path that extends between the sheet processing apparatus inside the in-body space part and the image forming part, and the second conveying path extends substantially horizontally inside the in-body space part and then extends while bending substantially vertically downward outside the in-body space part.

3. The image forming apparatus according to claim 2, wherein the first stacking part is configured to be elevated/lowered, and the part of the second conveying path that extends substantially vertically is disposed in a space part between an elevating/lowering trajectory of the first stacking part and the image forming part.

4. The image forming apparatus according to claim 3, further comprising a drive unit for elevating/lowering the first stacking part, wherein the drive unit and the part of the second conveying path that extends substantially vertically overlap each other in the space in a direction perpendicular to a sheet conveying direction.

5. The image forming apparatus according to claim 1, further comprising:

a third discharge part provided vertically above the first discharge part and configured to discharge the sheet to the in-body space part; and another stacking part provided vertically above the relay conveying unit and configured to stack sheets discharged from the third discharge part.

6. A sheet conveying apparatus that can be attached to an image forming system including: an image reading part for reading an image; an image forming part provided vertically below the image reading part and configured to form an image on a sheet; an in-body space part provided between the image reading part and the image forming part; a sheet processing apparatus including a sheet processing part provided inside the in-body space part between the image reading part and the image forming part and configured to apply predetermined processing to sheets and a first stacking part disposed adjacent to the sheet processing part and outside the in-body space part and configured to stack thereon the sheets processed by the sheet processing part, the sheet conveying apparatus comprising:

a sheet receiving part for receiving a sheet on which an image is formed by the image forming part and discharged to the in-body space part;

a sheet discharge part provided outside the in-body space part and vertically below the first stacking part and configured to discharge the sheet;

a first conveying path for conveying the sheet received by the sheet receiving part toward the sheet processing apparatus; and a second conveying path provided so as to extend between the sheet processing apparatus inside the in-body space part and the image forming part and configured to convey the sheet received by the sheet receiving part toward the sheet discharge part.

7. The sheet conveying apparatus according to claim 6, wherein the sheet discharge part is disposed vertically below a part of the second conveying path that extends between the sheet processing apparatus inside the in-body space part and the image forming part, and the second conveying path extends substantially horizontally inside the in-body space part and then extends while bending substantially vertically downward outside the in-body space part.

* * * * *